US011519301B2

(12) United States Patent
Milne

(10) Patent No.: US 11,519,301 B2
(45) Date of Patent: Dec. 6, 2022

(54) SAFETY APPARATUS AND CORRESPONDING METHOD FOR CONTAINING AN ENERGY RELEASE FROM A TENSION STUD OF A ROTOR ASSEMBLY

(71) Applicant: Siemens Energy Global GmbH & Co. KG, Bayern (DE)

(72) Inventor: Trevor Milne, Sheffield (GB)

(73) Assignee: Siemens Energy Global GmbH & Co. KG, Bayern (DE)

( * ) Notice: Subject to any disclaimer, the term of this patent is extended or adjusted under 35 U.S.C. 154(b) by 39 days.

(21) Appl. No.: 17/284,934

(22) PCT Filed: Aug. 12, 2019

(86) PCT No.: PCT/EP2019/071559

§ 371 (c)(1),
(2) Date: Apr. 13, 2021

(87) PCT Pub. No.: WO2020/088811

PCT Pub. Date: May 7, 2020

(65) Prior Publication Data

US 2021/0348527 A1 Nov. 11, 2021

(30) Foreign Application Priority Data

Oct. 30, 2018 (EP) ..... 18203329

(51) Int. Cl.

| | |
|---|---|
| ***F01D 25/28*** | (2006.01) |
| ***F01D 5/06*** | (2006.01) |
| ***F01D 25/24*** | (2006.01) |

(52) U.S. Cl.

CPC ..... *F01D 25/285* (2013.01); *F01D 5/066* (2013.01); *F01D 25/243* (2013.01);
(Continued)

(58) Field of Classification Search

CPC ..... F01D 25/28; F01D 25/285; F01D 25/243; F01D 21/045; F01D 5/066;
(Continued)

(56) References Cited

U.S. PATENT DOCUMENTS

| | | | | |
|---|---|---|---|---|
| 2006/0013693 | A1 | 1/2006 | Meacham et al. | |
| 2013/0125559 | A1* | 5/2013 | Shepherd | F01D 5/066 60/796 |
| 2017/0130609 | A1* | 5/2017 | Tye | F04D 29/321 |

FOREIGN PATENT DOCUMENTS

| | | | |
|---|---|---|---|
| DE | 2426231 | A1 | 12/1975 |
| EP | 1983161 | A1 | 10/2008 |

(Continued)

OTHER PUBLICATIONS

International search report and written opinion dated Oct. 28, 2019 for corresponding PCT/EP2019/071559.

*Primary Examiner* — Christopher Verdier
*Assistant Examiner* — Maxime M Adjagbe
(74) *Attorney, Agent, or Firm* — Wolter Van Dyke Davis, PLLC

(57) ABSTRACT

A safety apparatus for containing a release of energy from a tension stud of a rotor assembly, the safety apparatus including a containment member configured to pivot about a pivot location, the containment member including a retaining arm located on a first side of the pivot location and a catch located on a second side of the pivot location, wherein the containment member is movable about the pivot location to a first position in which the catch is engaged with a lip of a disc of the rotor assembly to position the retaining arm in a containment position.

15 Claims, 6 Drawing Sheets

(52) U.S. Cl.
CPC ..... *F05D 2230/64* (2013.01); *F05D 2260/31* (2013.01); *F05D 2260/38* (2013.01)

(58) Field of Classification Search
CPC ..... F05D 2230/64; F05D 2260/30; F05D 2260/33; F05D 2260/34; F05D 2260/36; B23P 19/107; B23P 19/067; B23P 19/04; B23P 19/02; B25B 23/103; B25B 23/10
USPC ..... 81/DIG. 9
See application file for complete search history.

(56) References Cited

FOREIGN PATENT DOCUMENTS

| | | | |
|---|---|---|---|
| EP | 2933433 | A1 | 10/2015 |
| EP | 3168588 | A1 | 5/2017 |

* cited by examiner

SAFETY APPARATUS AND CORRESPONDING METHOD FOR CONTAINING AN ENERGY RELEASE FROM A TENSION STUD OF A ROTOR ASSEMBLY

CROSS REFERENCE TO RELATED APPLICATIONS

This application is the US National Stage of International Application No. PCT/EP2019/071559 filed 12 Aug. 2019, and claims the benefit thereof. The International Application claims the benefit of European Application No. EP18203329 filed 30 Oct. 2018. All of the applications are incorporated by reference herein in their entirety.

FIELD OF INVENTION

The present disclosure relates to a safety apparatus for containing loads applied to shaft arrangements particularly, but not exclusively for turbo engines and turbo-machines having a compressor, a turbine or a power turbine mounted to an axial shaft.

BACKGROUND

In gas turbine engines, compressors and turbines typically have axially arranged sets of rotors, each comprising an array of blades mounted to rotor discs. The respective sets of rotors are located between end shafts on a tension stud that extends through all or part of the set of rotors. In operation, the rotation of the rotors causes high separation forces to develop in the rotors. To counter these separation loads, a compression load is applied to the shaft and the rotors prior to use to offset the separation loads that develop in operation. To develop the compression load in the shaft and rotors, the tension stud is stretched during assembly to develop a tension within the tension stud. The tension stud is then held in its stretched form by a load retainer that engages with the shaft. The tension stud will react against the shaft via the load retainer to apply the compression load to the shaft.

Due to the high loads required to counter the separation loads encountered in operation, the risk of injury to assembly fitters due to an energy release resulting from a failure of one or more components of the rotor assembly is high.

To overcome this problem, each component of the tooling assemblies is designed with a high factor of safety, which leads to increased size and weight of each component as well as increased expense. Further, each component is subject to regular non-destructive testing, which is time-consuming and leads to increased assembly time.

An alternative solution to overcome this problem is to utilise a robotic assembly to avoid interaction of an operator with the tool assembly during loading of the tension stud. However, this leads to significant expense.

Hence a need for improving the system for applying a tension load to the tension stud is highly desirable.

SUMMARY

According to the present disclosure there is provided an apparatus and method as set forth in the appended claims. Other features of the invention will be apparent from the dependent claims, and the description which follows.

According to a first aspect of the invention, there is provided a safety apparatus for containing a release of energy from a tension stud of a rotor assembly. The safety apparatus includes a containment member configured to pivot about a pivot location. The containment member includes a retaining arm located on a first side of the pivot location and a catch located on a second side of the pivot location, wherein the containment member is movable about the pivot location to a first position in which the catch is engaged with a lip of a disc of the rotor assembly to position the retaining arm in a containment position. Hence there is provided a safety apparatus suitable for containing a load applied to a tension stud of a rotor assembly in the event of a failure of one or more components and/or connections of the rotor assembly. The provision of the safety apparatus significantly reduces the risk to nearby workers and equipment as any energy released by a failure of one or more components will be restrained by the safety apparatus. Further, the provision of safety apparatus as part of the tool assembly avoids the necessity to redesign current components, which are already in operation.

In one example, the catch is substantially hook shaped.

The safety apparatus may include a handle configured to move the containment member between the first position in which the catch is engaged with the lip of the disc of the rotor assembly and a second position in which the catch is not engaged with the lip of the disc of the rotor assembly.

The handle may include a cam shaped outer profile at an engagement location with the containment member, wherein the handle is movable relative to the containment member at the engagement location to move the containment member about the pivot.

In one example, there is provided a tool assembly for applying a load to a tension stud of a rotor assembly. The tool assembly may include at least one safety apparatus and a tool apparatus. The tool apparatus may include a tool head for connecting to the tension stud, a compression body for engaging with a disc of the rotor assembly and an actuator for applying a load to the tool head and the compression body, wherein the at least one safety apparatus is connected to the tool apparatus via the pivot. The provision of the tool assembly including the safety apparatus enables the load to be applied to the tension stud and shaft of a rotor assembly in a safe manner.

The tool assembly may include two diametrically opposed safety apparatus connected to the tool apparatus. The provision of two diametrically opposed safety apparatus means that the energy released as a result of a failure will be shared between the two safety apparatus.

The tool assembly may include a biasing member configured to bias the containment member so the catch is not engaged with the lip of the disc of the rotor assembly.

The tool head may include a removable insert, the removable insert including a male thread for engaging with a co-operative female thread of the tool head and a female thread for engaging with a co-operative male thread of the tension stud. The removable insert may be made of a higher grade material compared with the rest of the tool head and so prolong the usable lifetime of the tool head.

The compression body may include a substantially cylindrical sidewall comprising an aperture. The provision of a substantially cylindrical sidewall comprising an aperture enables an operator to access the inside of the compression body. In one example, the operator is able to access a connector connected to a load retainer within the compression body.

The tool assembly may include a measurement apparatus configured to measure the elongation of the tension stud. The measurement apparatus may be used to determine that the tension stud has extended by a pre-determined amount, equivalent to a pre-determined tension load being developed in the tension stud and hence, a pre-determined compression load being applied to the shaft.

In one example, the measurement apparatus comprises a plunger configured to extend through the tool head and engage with the tension stud.

According to another aspect of the invention, there is provided a method of applying a load to a tension stud of a rotor assembly. The method may include connecting the tool assembly to the tension stud, engaging the compression body of the tool assembly with the disc of the rotor assembly, engaging the catch of the safety apparatus with the lip of the disc of the rotor assembly, actuating the actuator to apply a load to the tool head and the compression body, which causes a tension load in the tension stud. This method enables a load to be safely applied to the tension stud.

The catch of the safety apparatus may be engaged with the lip of the disc of the rotor assembly by movement of the handle.

The method may also include the step of measuring the elongation of the tension stud via measurement apparatus. The measurement apparatus may be used to determine that the tension stud has extended by a pre-determined amount, equivalent to a pre-determined tension load being developed in the tension stud and hence, a pre-determined compression load being applied to the shaft.

The method may also include the step of determining that the tension stud has elongated by a predetermined amount and rotating a connector connected to a load retainer which is co-operatively threaded to the tension stud, wherein the load retainer is moved so that it engages with the shaft of the rotor assembly.

BRIEF DESCRIPTION OF THE DRAWINGS

Examples of the present disclosure will now be described with reference to the accompanying drawings, in which.

DETAILED DESCRIPTION

Figure 1:
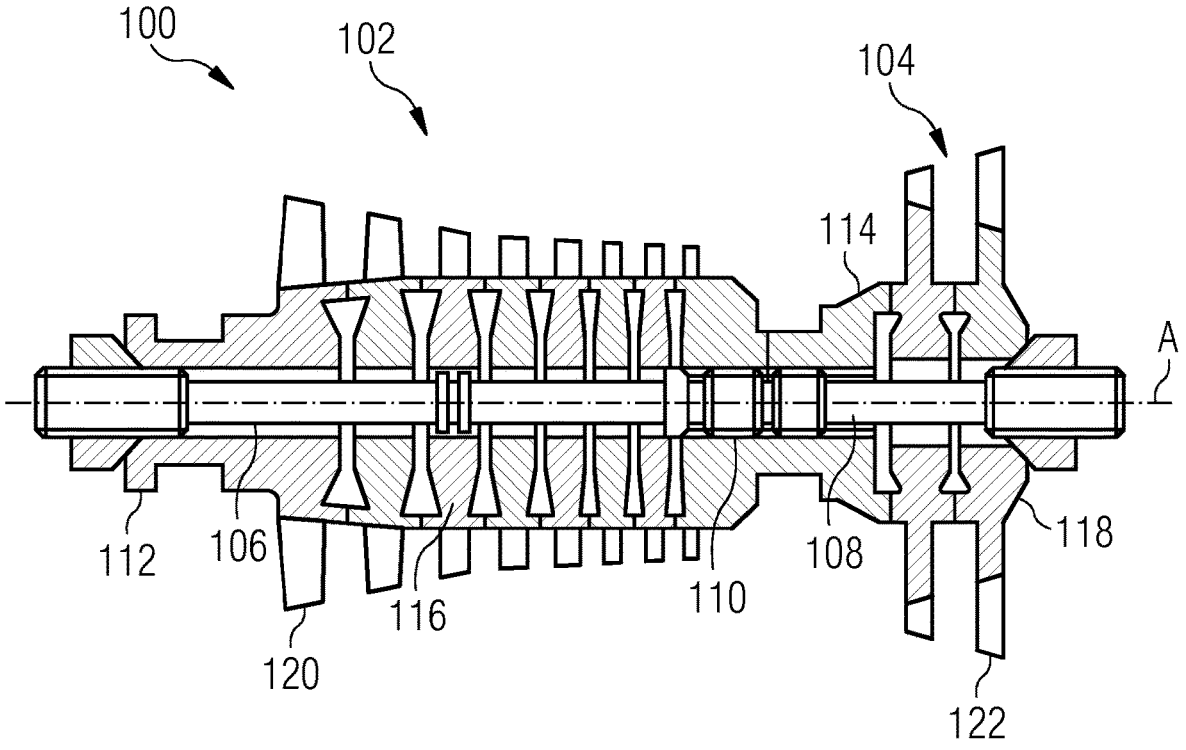
FIG. 1 shows a schematic of a gas turbine arrangement.

FIG. 1 shows an example of a rotor assembly 100 of a gas turbine engine. The rotor assembly 100 shown in FIG. 1 includes a compressor rotor 102 and a compressor turbine 104. In example, the turbine engine is an SGT-100, SGT-300 or SGT-400.

A tension stud or tension bolt 106 is provided in the axial centre of the rotor assembly 100, along an axis A of rotation of the rotor assembly 100. In one example, the compressor rotor 102 has a compressor tension stud 106 and the compressor turbine 104 has a turbine tension stud 108. The compressor tension stud 106 and the turbine tension stud 108 may be connected together via a threaded connector 110.

In operation, the rotor assembly 100 is arranged to rotate about the axis A of rotation. All rotor parts shown in the figures may be substantially rotationally symmetric about the axis A of rotation. Stator parts are not shown in the figures and elements that interlock the rotors may not be shown in the figures.

The rotor assembly 100 includes one or more shaft elements, for example, an inlet shaft 112 and an exit shaft 114.

The inlet shaft 112 and compressor discs 116 are provided around the compressor tension stud 106 and configured to rotate about the axis A of rotation.

Further, the exit shaft 114 and turbine discs 118 are configured to rotate about the turbine tension stud 108.

The inlet shaft 112 and the compressor discs 116 may be interlocked axially between axially adjacent rotating parts. Further, the turbine discs 118 and exit shaft 114 may be interlocked axially between axially adjacent rotating parts.

For example, the inlet shaft 112 and the compressor discs 116 may comprise corresponding teeth that mesh together to interlock the inlet shaft 112 and the compressor disc 116. A plurality of rotor blades 120 are held in place by the compressor discs 116. In one example, a rotor blade 120 comprises a "t-shaped" root that is held in place between correspondingly shaped sections of the compressor discs 116. In other examples, the rotor blades 120 may extend from the compressor discs 116 themselves in the form of a blisk.

The compressor turbine 104 has a similar arrangement to the compressor rotor 102 in which a plurality of turbine rotor blades 122 may be held in place by the turbine discs 118. In one example, a rotor blade 122 comprises a "t-shaped" or "fir-tree" shaped roots that are held in place between correspondingly shaped sections of the turbine discs 118. In other examples, the rotor blades 122 may extend from the turbine discs 118 themselves, in the form of a blisk.

As such, the compressor tension stud 106, the inlet shaft 112, the compressor discs 116 and the rotor blades 120 may rotate together at the same speed about the axis A of the rotor assembly 100.

Further, the exit shaft 114, the turbine tension stud 108, the turbine discs 118 and the turbine blades 122 may rotate together at the same speed about the axis A of the rotor assembly 100.

In one example of assembly, the exit shaft 114 is mounted vertically in a frame and the rotor assembly 100 is constructed in a top-down vertical orientation. In another example, the exit shaft 114 is mounted horizontally in a frame and the rotor assembly 100 is constructed in a horizontal orientation.

Figure 2:
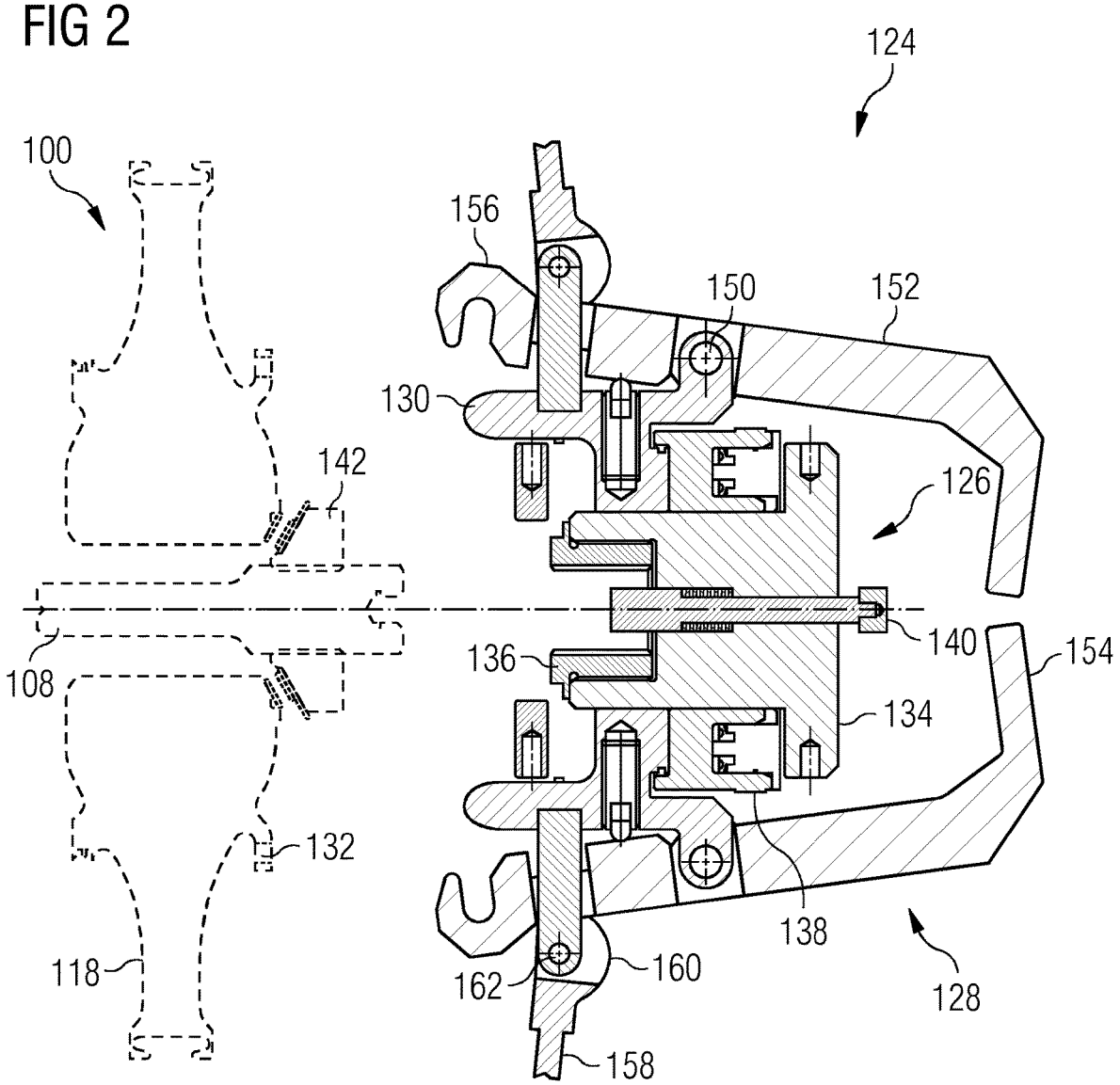
FIG. 2 shows a cross section of a schematic of part of the rotor assembly and a tool assembly.

FIG. 2 shows a cross section of a schematic of part of the rotor assembly 100 along with a tool assembly 124 for applying load energy to the turbine tension stud 108.

The tool assembly 124 includes a tool apparatus 126 and a safety apparatus 128. The tool apparatus 126 includes a compression body 130 configured to engage with the turbine disc 118 of the rotor assembly 100. In one example, the compression body 130 has a profile at one end that may correspond with a shape of the turbine disc 118 to ensure a positive engagement between the compression body 130 and the turbine disc 118. The compression body 130 may be received in a cavity formed by a lip 132 or rim on the turbine disc 118, such that in use, one end of the compression body 130 abuts against the lip 132 of the turbine disc 118.

The compression body 130 may be substantially cylindrical with an axial hole therethrough such that one end of the tension stud 108 may be received in the compression body 130. The compression body 130 may have substantially cylindrical shaped walls and may include an aperture to enable access to the inside of the compression body 130. The compression body 130 also includes a projection angled away from the cylindrical wall of the compression body 130 to provide a pivot point 150 for the safety apparatus 128.

The tool apparatus 126 includes a tool head 134 configured to connect to the turbine tension stud 108. The tool head 134 may be substantially cylindrical and include a first region having a first diameter and a second region having a second, smaller diameter, creating a lip to enable an actuator 138 to engage with the tool head 134 and exert a load thereon. The compression body 130 is sized to receive at least part of the tool head 134 within the axial hole of the compression body 130.

In FIG. 2, the tool head 134 is not engaged with the tension stud 108. In one example, the tool head 134 includes a female threaded connection which is configured to engage with a corresponding male threaded connection on the tension stud 106.

Within the tool apparatus 126 there are critical cyclic life components that require monitoring during their repeated use, the female thread of the tool head 134 that engages with the tension stud 106 is one such component. To minimise the cost of replacing the entire tool head 134 once the internal female thread of the tool head 134 has worn to an undesirable state, the tool head 134 may include a removable insert 136 such that the tool head 134 is connected to the tension stud 106 via the removable insert 136. In one example, the removable insert 136 includes a male thread for engaging with a co-operative female thread within the tool head 134 and a female thread for engaging with a co-operative male thread of the tension stud 106. The removable insert 136 may be economically made from higher grade material compared with the remainder of the tool head 134. Further, the removable insert 136 may be changed-out with a spare or replacement removable insert 136 whilst the original is away for inspection. This enables continued use of tool apparatus 126 whilst the original removable insert 136 is being inspected. Further, the removable insert 136 may comprise a non-shouldered outer thread, which enables its reversal. As such, the usable life of the removable insert is extended because the redundant thread is utilised.

The tool apparatus 126 includes an actuator 138 configured to apply a load to the tool head 134 and the compression body 130. The actuator 138 may have an axial hole therethrough for receiving at least part of the tool head 134.

The tool apparatus 126 may include a measurement device 140 for measuring the stretch or elongation of the turbine tension stud 108. The measurement device 140 will be explained in more detail below.

The rotor assembly 100 includes a load retainer 142 and a connector 144, which will be explained in more detail below.

Figure 3:
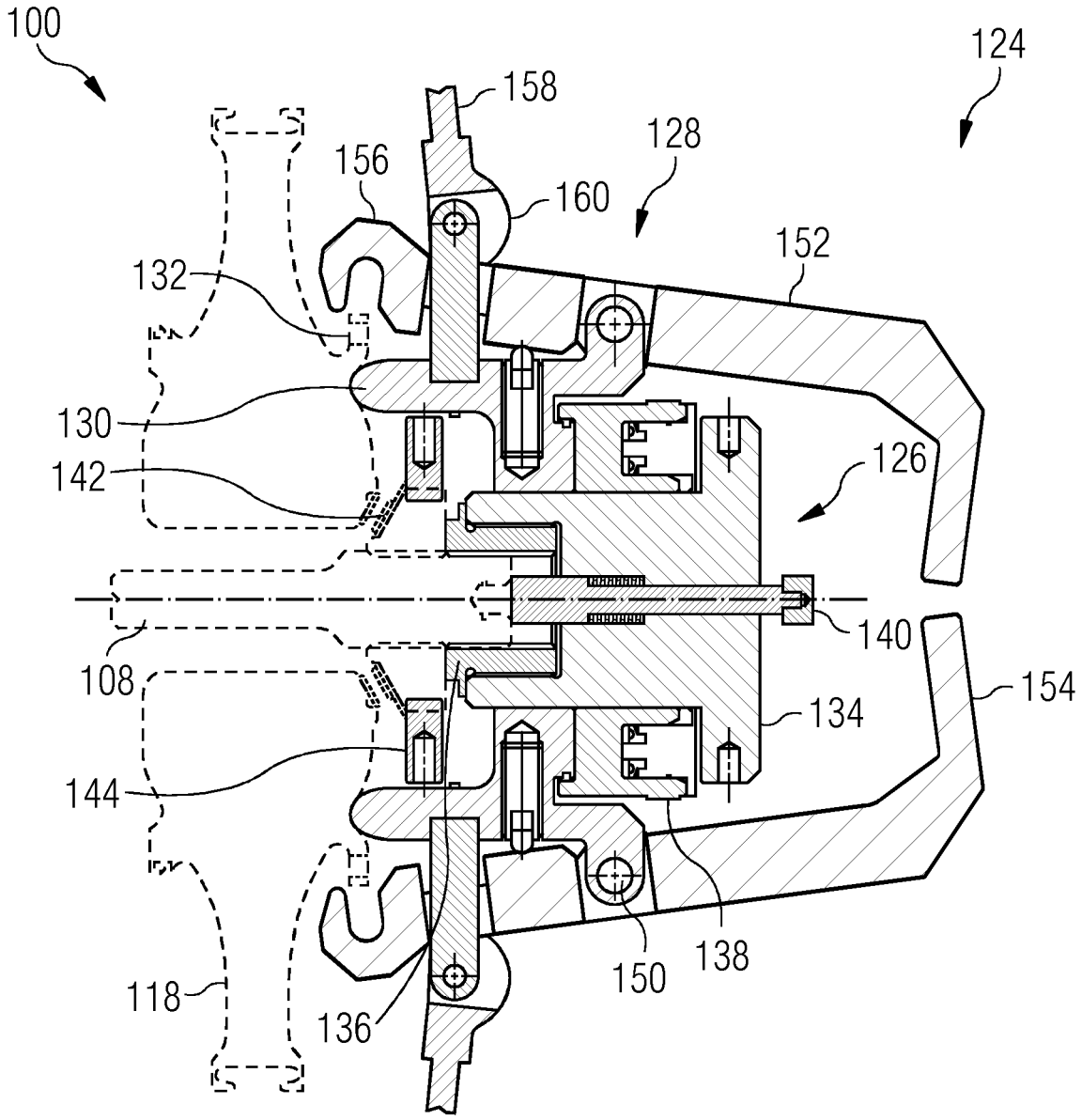
FIG. 3 shows a cross section of a schematic of part of the rotor assembly and a tool assembly in a second, open position.

FIG. 3 shows a cross section of a schematic of part of the rotor assembly 100 along with the tool assembly 124 for applying a load to the turbine tension stud 108. In the example shown in FIG. 3, the tool head 134 is engaged with the tension stud 108 via the replaceable tool insert 136 and the safety apparatus 128 is shown in a second, open position, wherein the catch 156 of the safety apparatus 128 is not engaged with the lip 132 of the turbine disc 118. In the example shown in FIG. 3, the tool head 134 is received in the through hole in the compression body 130 and the removable insert 136 is engaged with the tension stud 108.

Figure 4:
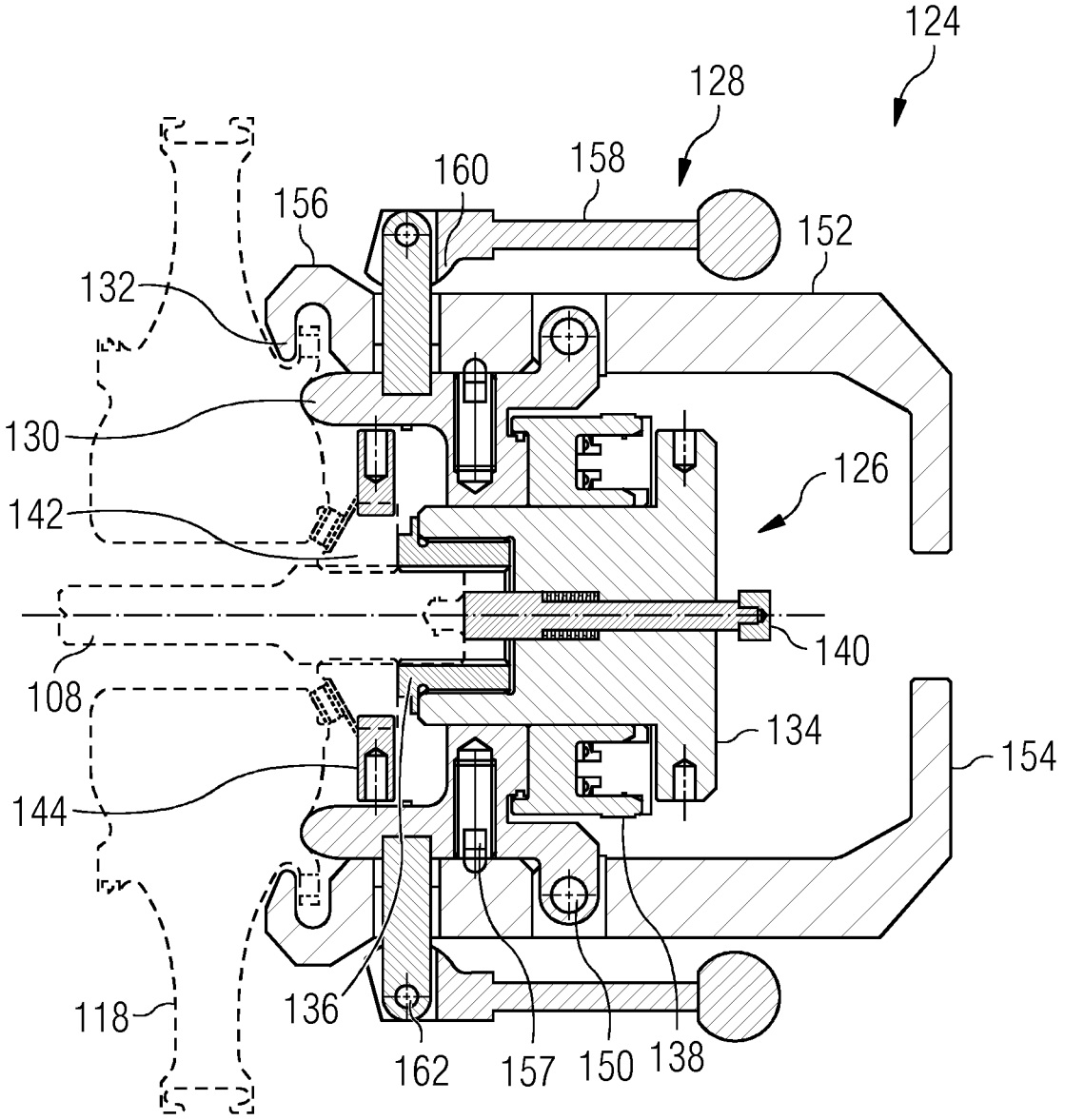
FIG. 4 shows a cross section of a schematic of part of the rotor assembly and a tool assembly in a first, containment position.

FIG. 4 shows a cross section of a schematic of part of the rotor assembly 100 along with the tool assembly 124 for applying a load to the turbine tension stud 108. In the example shown in FIG. 4, the tool head 134 is engaged with the tension stud 108 via the replaceable tool insert 136 and the safety apparatus 128 is shown in a first, containment position, wherein the catch 156 of the safety apparatus 128 is engaged with the lip 132 of the turbine disc 118.

In the arrangement of FIG. 4, the actuator 138 is engaged with the tool head 134 and the compression body 130. In operation, the actuator 138 is configured to expand to push against the tool head 134 and the compression body 130 and exert a load on the tool head 134 and the compression body 130. As the compression body 130 is engaged with the turbine disc 118 of the rotor assembly 100, the force applied to the compression body 130 will be reacted by the turbine disc 118 and the turbine disc 118 will also be subject to compression.

In one example, the actuator 138 is a hydraulic load cell to accurately apply a pre-determined load to the tension stud 108. In other examples, the actuator 138 may be a pneumatic load cell, a torqued threaded arrangement or an electric solenoid.

Due to the connection between the tool head 134 and the tension stud 108, the load applied to the tool head 134 results in an extension of the tension stud 108 and a tension load to develop in the tension stud 108.

The load applied to the tension stud 108 is pre-determined to match the 'steady state' separation loads experienced in operation of the turbine assembly 104. In one example, to determine the tension load applied to the turbine tension stud 108, a change in length or extension of the turbine tension stud 108 is measured by a measurement device 140. The measurement device 140 may include a sliding plunger that projects through the tool head 134 and engages with an end of the turbine tension stud 108. The measurement device 140 may have an exposed end that projects from the tool head 134. In one example, the measurement device 140 includes a spring to bias the plunger against an end of the turbine tension stud 108. The exposed end of the measurement device 140 may be fixed such that the elongation or extension of the tension stud 108 may be measured due to the corresponding reduction in length of the measurement device 140.

Due to the stress-strain relationship, a pre-determined tension load can be provided to the tension stud 108 by stretching the tension stud 108 by a predetermined amount.

Once the turbine tension stud 108 has been extended by a pre-determined amount, corresponding to a pre-determined tension load being developed in the turbine tension stud 108, a load retainer 142 is moved to engage with the turbine disc 118. The load retainer 142 is moved relative to the turbine tension stud 108 to engage with the turbine disc 118. In one example, a connector 144, which may be in the form of a spinner, is connected with the load retainer 142 to enable an operator to move the load retainer 142 relative to the turbine tension stud 108, without the need for the operator to have direct access to the load retainer 142. In one example, the load retainer 142 comprises a threaded nut configured to receive a corresponding thread on the turbine tension stud 108.

In order to access the connector 144, the wall of the compression body 130 may include an aperture to enable access to the inside the compression body 130.

Following the engagement of the load retainer 142 with the turbine disc 118, the actuator 138 may be unloaded. During unloading, the load path between the turbine tension stud 108 and the turbine disc 118 is changed from passing through the compression body 130 to passing through the load retainer 142. In other words, the compression body 130 becomes unloaded as the actuator 138 is unloaded and the load retainer 142 becomes loaded as the actuator 138 is unloaded.

Once the actuator 138 has been fully unloaded, the tool assembly 124 can be removed.

In operation, depending on the size of the rotor assembly 100, the rotor assembly 100 may be subject to separation loads of approximately 50 kN. In other examples, the separation loads may be more than 250 kN, more advantageously more than 500 kN, more advantageously more than 750 kN and more advantageously more than 1000 kN. To compensate against this separation load, the turbine tension stud 108 will be subject to a matching tension load. As such, the components of the tool apparatus 126 and rotor assembly 100 will also be subject to high loads. Whilst the components are designed to withstand the loads applied to them, in practice, there are a number of reasons why failures in the components and/or connections of the rotor assembly 100 that are subject to a load may occur.

A first source of potential failure is that one or more threads between connecting elements may fail. For example, the thread between the load retainer 142 and the turbine tension stud 108 may fail, causing the load energy within the tension stud 108 to be released.

Alternatively, the threads between the removable insert 136 and either the corresponding thread of the tool apparatus 126 or the corresponding thread of the turbine tension stud 108 may fail during loading of the turbine tension stud 108, which causes the load energy from the actuator 138 to be unrestrained at one end.

In another example, there may be a lack of engagement between the compression body 130 and the turbine disc 118 or the actuator 138 and the tool head 134 or the compression body 130.

Further, the load applied by the actuator 138 may be too high, or higher than the capacity of one or more of the components and/or connections, resulting in a failure of one or more components and/or connection between components.

In each of these examples, a release of energy occurs, which may cause injury to a nearby operator or damage to nearby equipment. The energy released may be between approximately 1500 J to 4000 J and so the safety apparatus 128 is designed to withstand and contain this release of energy.

FIGS. 2, 3 and 4 all show an example of the tool assembly 124 including a tool apparatus 126 and a safety apparatus 128. In the examples shown in FIGS. 2, 3 and 4, the tool assembly 124 includes two safety apparatus 128 arranged diametrically opposite on the tool apparatus 126. However, other arrangements of tool assembly 124 are possible; for example, the tool assembly 124 may have more or fewer than two safety apparatus 128.

The safety apparatus 128 or catcher arm is used with the tool apparatus 126 to safely apply a tension load to the turbine tension stud 108 with a reduced risk of an undesired energy release outside of the tool assembly 124 as the safety apparatus 128 is configured to contain the load energy released from the tension stud 108 due to a failure of one or more components.

Where possible all components of the tool apparatus 126 are designed to meet mechanical strength requirements for a given cyclic life with acceptable safe working margins. At a given time during assembly, operators must access the tool assembly 124 (i.e. measuring stretch and dismantling tooling). During this time, it is especially essential to provide a second-tier of safety to "fool-proof" against failure scenarios such as accidental over pressure of the actuator and/or damaged or worn threads. This is achieved by the addition of the safety apparatus 128 to the tool apparatus 126. In the event of a component failure, the safety apparatus 128 are configured to contain to the energy released from the tension stud 108 and/or one of the other components subject to loading.

The safety apparatus 128 includes a containment member 152 which is pivotable about a pivot 150. The pivot 150 may be provided by the compression body 130, for example, via the projection of the compression body 130. Alternatively, the pivot 150 may be part of the safety apparatus 128. The pivot 150 may comprise a retaining bolt configured to be received within a corresponding hole, which enables the containment member 152 to pivot about the hole.

In the examples shown in FIGS. 2, 3 and 4, the pivot 150 has a pivot housing that is configured to connect to the tool apparatus 126. In one example, the containment member 152 is connected to the compression body 130 of tool apparatus 126.

The containment member 152 includes a retaining arm 154 located on a first side of the pivot 150. In one example, the retaining arm 154 has a curved or hooked shape such that a first part of the retaining arm 154 is at an angle to a second part of the retaining arm.

The safety apparatus 128 also includes a catch 156 located on the second side of the pivot 150. The catch 156 is configured to engage with the lip 132 of the disc 118 of the rotor assembly 100. In one example, the catch 156 is substantially hook shaped to enable it to hook onto the lip or rim 132 of the turbine disc 118. The catch 156 is shaped such that its shape corresponds with the shape of the lip 132 to provide a positive engagement between the catch 156 and the lip 132.

The containment member 152 is movable about the pivot 150 to a first position in which the catch 156 is engaged with the lip 132 of the disc 118 of the rotor assembly 100 and a second position in which the catch 156 is not engaged with the lip 132 of the disc 118 of the rotor assembly 100. In the first position, in which the catch 156 is engaged with the lip 132 of the disc 118, the retaining arm 154 is in a containment position such that it will be able to contain any load released from the actuator 138 and or tension stud 108 as a result of a failure of one or more components and/or connections. In the containment position, the retaining arm 154 overlaps with at least part of the tool apparatus 126 in the direction of the rotational axis A of the rotor assembly 100, and the catch 156 is located on the lip 132 of the disc 118. Thus, if the tool head 134 is moved away from the disc 118, as a result of a failure and release of energy, then the tool head 134 will contact the retaining arm 154 of the safety apparatus 128. The retaining arm 154 will be subject to a shear force, axial force and bending moment and is sized to withstand these forces. In addition, the connection between the catch 156 and the lip 132 will also be subject to high forces as a result of a failure and release of energy and the catch 156 is sized to withstand these forces.

In one example, the material of the safety apparatus 128 is a nickel chromium molybdenum steel, which is advantageously due to its high tensile strength and toughness.

The safety apparatus 128 may also include a handle 158. A user may operate the handle 158 to move the containment member 152 between the first position in which the catch 156 is engaged with the lip 132 of the disc 118 of the rotor assembly 100 and a second position in which the catch 156 is not engaged with the lip 132 of the disc 118 of the rotor assembly 100.

In one example, the handle 158 includes a region 160 having cam shaped outer profile at an engagement location with the containment member 152. The handle 158 may be connected to the tool apparatus 126 via a second pivot 162. In one example, the handle 158 is connected to the compression body 130 of the tool apparatus 126 and the containment member 152 is located between the second pivot 162 and the compression body 130 and the cam shaped outer profile of the handle 158 is engaged with the containment member 152. As such, when the handle 158 is moved about the second pivot 162, the containment member 152 will be moved about the first pivot 150 due to the shape of the cam shaped outer profile. As such, movement of the handle 158 will result in the containment member 152 being moved between a first, containment position and a second, open position.

In one example, the containment member 152 includes an elongate region defining a longitudinal axis. In one example, the catch 156 is located at a proximal end of the elongate region and the retaining arm 154 is located at the distal end of the elongate region. The catch 156 and the retaining arm 154 may project away from the longitudinal axis of the elongate region in substantially the same direction. In one example, at least part of the retaining arm 154 defines a second axis. The longitudinal axis defined by the elongate region and the second axis defined by the retaining arm 146 may be substantially perpendicular.

In one example, the containment member 142 has a substantially rectangular shaped cross section, but any suitable cross section may be used.

The catch 156 and retaining arm 154 may be part of the same component or, alternatively, they may be distinct components that are joined together.

Where the tool assembly 124 comprises a first safety apparatus 128 and a second safety apparatus 128, as shown, the retaining arm 154 of a first safety apparatus 128 may project towards the retaining arm 154 of the second safety apparatus 128 and the retaining arm 154 of the second safety apparatus 128 may project towards the retaining arm 154 of the first safety apparatus 128. Put another way, retaining arms 154 of different safety apparatus 128 may project towards each other in the tool assembly 124.

The containment member 152 is configured to pivot about a pivot location 150 between a first position in which the catch 156 is engaged with the lip 132 of the disc 118 and the retaining arm 154 is in a containment position for containing a load applied to a turbine tension stud 108 of a rotor assembly 100, as shown in FIG. 4, and a second, position in which the catch 156 is disengaged with the lip 132 of the disc 118 and the retaining arm 154 is in a non-containment position, as shown in FIGS. 2 and 3. In the containment position, at least part of the retaining arm 154 overlaps with at least part of the tool apparatus 126, such as the tool head 134, in the direction of the rotational axis A of the rotor assembly 100. In addition, the catch 156 is engaged with the lip 132 of the disc 118. In the containment position, the safety apparatus 128 is configured to contain the load within the tension stud 108. When the containment member 152 is in the second, non-containing position, the containment member 152 is not configured to contain loads therein.

The tool assembly 124 may include a biasing member 157, such as a pre-loaded spring, configured to bias the containment member 152 in the second position.

The containment member 152 is sized such that it can withstand the various loads resulting from a failure and release of energy of one or more components of the tool apparatus 126 and/or rotor assembly 100 whilst the load is being applied to the tension stud 108 or after the load has been applied to the tension stud 108.

Figure 5:
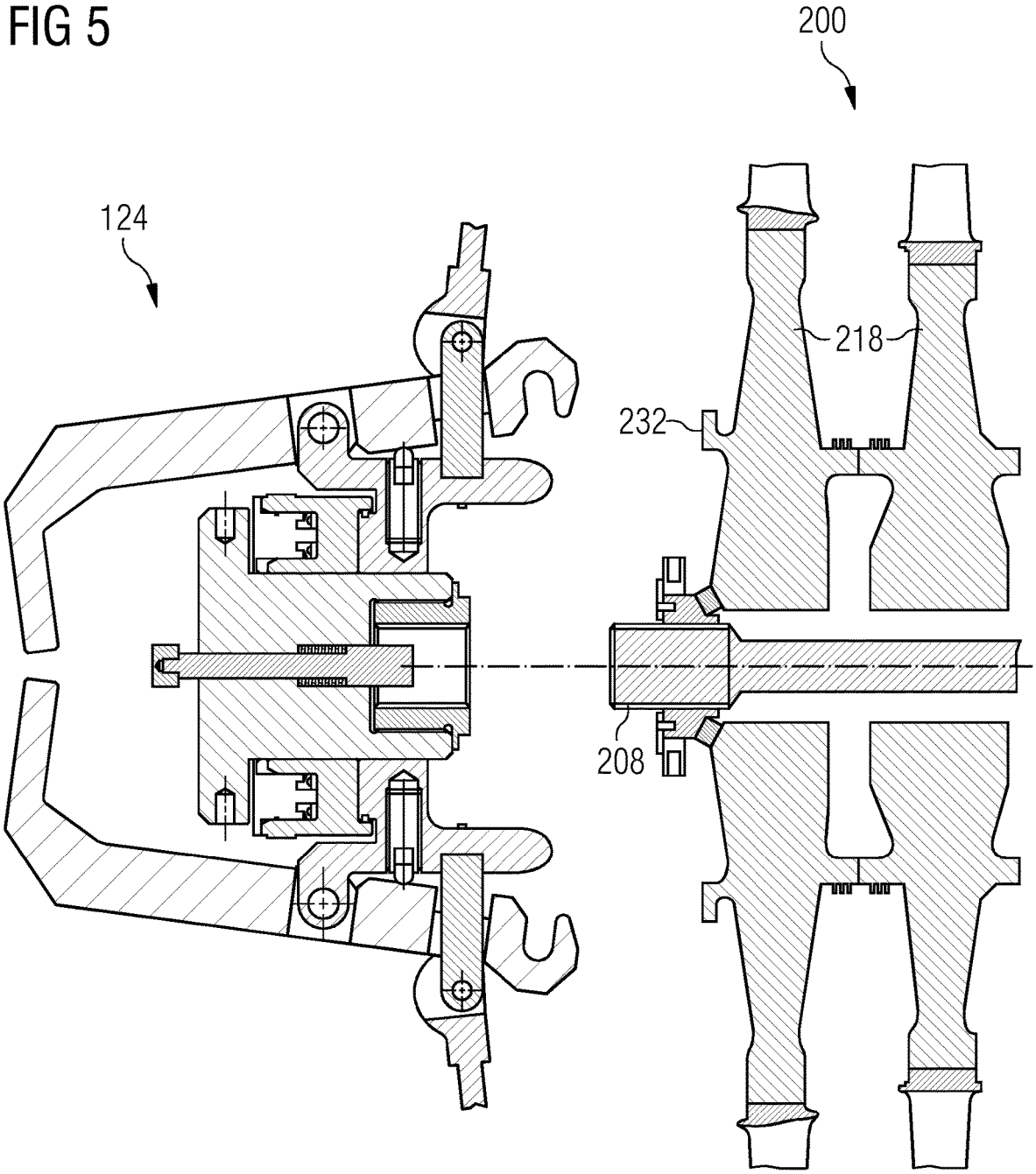
FIG. 5 shows a cross section of a schematic of part of the rotor assembly and a tool assembly.

The safety apparatus 128 of the tool assembly 124 may be configured to operate with different compressor/turbine arrangements. FIG. 5 shows an example of the tool assembly 124 and a part of a power turbine 200. In the example shown in FIG. 5, the power turbine 200 includes a plurality of turbine discs 218, the outer most of which includes a lip or rim 234 on which the catch 156 of the safety apparatus 128 may engage. The tool assembly 224 may be used to safely apply a tension load to a power turbine tension stud 208 in the same manner as applying a load to the turbine tension stud 108 of a turbine compressor. The operation of the tool assembly 224 is as described above.

Figure 6:
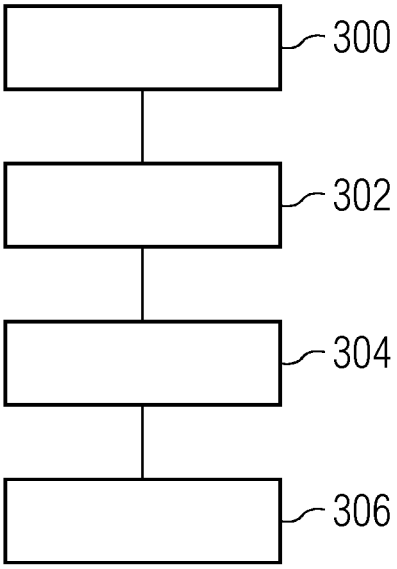
FIG. 6 shows a flow diagram of steps of a method of applying a load to a tension stud of a rotor assembly.

FIG. 6 shows an illustration of a method of applying a load to a tension stud 10 of a rotor assembly.

In step 300, the tool assembly 124 is connected with the tension stud 108. In one example, the tool head 134 is used to connect the tool assembly 124 to the tension stud.

In one example, the tool head 134 includes a removable insert 136 comprising a hollow cylinder in which both the outside face and the inside face of the hollow cylinder are threaded. The thread on the outer face of the removable insert 136 may connect with a corresponding thread of a cavity within the tool head 134 for receiving the removable insert 136. The thread on the internal face of the removable insert 136 may connect with a corresponding thread on the tension stud 108.

In step 302, the compression body 130 of the tool assembly 124 is engaged with the disc 118, 228 of the rotor assembly 100, 200. The compression body 130 may have one end that is shaped to match a corresponding profile on the disc 118, 228 such that a positive engagement occurs.

In step 304, the catch 156 of the safety apparatus 128 is engaged with the lip of the disc 118, 218 of the rotor assembly 100, 200. In one example, catch 156 may be moved into engagement by moving the handle 158. As the retaining arm 154 is fixed relative to the catch 156, the retaining arm 154 is moved into the containment position as the catch 156 is engaged with the lip 132, 232.

In step 306, the actuator 138 is actuated to apply a load to the tool head 134 and the compression body 130 to cause a tension load to develop in the tension stud 108, 208.

In a further step, the method may include measuring the elongation of the tension stud 108, 208 via measurement device 140. The method may further include determining that the tension stud 108, 208 has elongated by a predetermined amount and rotating the load retainer 142 which is co-operatively threaded to the tension stud 108, 208. The load retainer 142 is moved so that it engages with the tension stud 108, 208 of the rotor assembly 100, 200.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A safety apparatus for containing a release of energy from a tension stud of a rotor assembly, the safety apparatus comprising:

a containment member configured to pivot about a pivot location, the containment member comprising:

a retaining arm located on a first side of the pivot location; and a catch located on a second side of the pivot location, wherein the containment member is movable about the pivot location to a first position in which the catch is engaged with a lip of a disc of the rotor assembly to position the retaining arm in a containment position.

2. The safety apparatus according to claim 1, wherein the catch is substantially hook shaped.

3. The safety apparatus according to claim 1, wherein the safety apparatus comprises a handle configured to move the containment member between the first position in which the catch is engaged with the lip of the disc of the rotor assembly and a second position in which the catch is not engaged with the lip of the disc of the rotor assembly.

4. The safety apparatus according to claim 3, wherein the handle comprises a cam shaped outer profile at an engagement location with the containment member, wherein the handle is movable relative to the containment member at the engagement location to move the containment member about the pivot.

5. A tool assembly for applying a load to a tension stud of a rotor assembly, the tool assembly comprising:

at least one safety apparatus according to claim 1; and a tool apparatus comprising:

a tool head for connecting to the tension stud;

a compression body for engaging with the disc of the rotor assembly; and an actuator for applying a load to the tool head and the compression body, wherein the at least one safety apparatus is connected to the tool apparatus via the pivot.

6. The tool assembly of claim 5, comprising:

two diametrically opposed safety apparatus connected to the tool apparatus.

7. The tool assembly of claim 5, further comprising:

a biasing member configured to bias the containment member so the catch is not engaged with the lip of the disc of the rotor assembly.

8. The tool assembly according to claim 5, wherein the tool head comprises a removable insert, the removable insert comprising:

a male thread for engaging with a co-operative female thread of the tool head; and a female thread for engaging with a co-operative male thread of the tension stud.

9. The tool assembly according to claim 5, wherein the compression body comprises a substantially cylindrical sidewall comprising an aperture.

10. The tool assembly according to claim 5, further comprising:

a measurement apparatus configured to measure an elongation of the tension stud.

11. The tool assembly according to claim 10, wherein the measurement apparatus comprises a plunger configured to extend through the tool head and engage with the tension stud.

12. A method of applying a load to a tension stud of a rotor assembly, the method comprising:

connecting the tool assembly of claim 5 to the tension stud;

engaging the compression body of the tool assembly with the disc of the rotor assembly;

engaging the catch of the safety apparatus with the lip of the disc of the rotor assembly;

actuating the actuator to apply a load to the tool head and the compression body, which causes a tension load in the tension stud.

13. The method according to claim 12, wherein the catch of the safety apparatus is engaged with the lip of the disc of the rotor assembly by movement of a handle.

14. The method according to claim 12, further comprising:

measuring an elongation of the tension stud via a measurement apparatus.

15. The method according to claim 14, further comprising:

determining that the tension stud has elongated by a predetermined amount; and rotating a connector connected to a load retainer which is co-operatively threaded to the tension stud, wherein the load retainer is moved so that it engages with a shaft of the rotor assembly.

* * * * *